US006262406B1

(12) United States Patent
McKee et al.

(10) Patent No.: US 6,262,406 B1
(45) **Date of Patent: *Jul. 17, 2001**

(54) COMPACT QUICK-COOKING CONVECTIONAL OVEN

(75) Inventors: Philip R. McKee, Frisco; Earl R. Winkelmann, Garland; James K. Pool, III, Richardson, all of TX (US)

(73) Assignee: TurboChef Technologies, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/465,739

(22) Filed: Dec. 17, 1999

Related U.S. Application Data

(60) Division of application No. 09/199,902, filed on Nov. 25, 1998, now Pat. No. 6,060,701, and a continuation-in-part of application No. 09/169,523, filed on Oct. 9, 1998, now Pat. No. 6,008,483, and a continuation-in-part of application No. 09/064,988, filed on Apr. 23, 1998, now Pat. No. 6,140,626, and a continuation-in-part of application No. 09/053,960, filed on Apr. 2, 1998, now Pat. No. 5,990,466, and a continuation-in-part of application No. 08/863,671, filed on May 27, 1997, now Pat. No. 5,927,265.

(51) Int. Cl.[7] ..... H05B 6/68

(52) U.S. Cl. ..... 219/681; 219/702; 219/720; 99/325

(58) Field of Search ..... 219/681, 682, 219/683, 685, 710, 702, 720, 400, 401; 126/21 A; 99/451, 468, 474, 467, 325, 330

(56) References Cited

U.S. PATENT DOCUMENTS

| | | | | |
|---|---|---|---|---|
| 4,337,384 | * | 6/1982 | Tanaka et al. | 219/681 |
| 5,352,874 | * | 10/1994 | Gong | 219/720 |
| 5,434,390 | * | 7/1995 | McKee et al. | 219/681 |
| 5,525,782 | * | 6/1996 | Yoneno et al. | 219/682 |
| 5,676,044 | * | 10/1997 | Lara, Jr. | 126/21 A |
| 6,060,701 | * | 5/2000 | McKee et al. | 219/681 |

* cited by examiner

*Primary Examiner*—Philip H. Leung
(74) *Attorney, Agent, or Firm*—Amster, Rothstein & Ebenstein

(57) ABSTRACT

An oven for cooking a food product, at least partially by hot gas flow and at least partially by microwave energy, includes a housing defining a cooking chamber for receiving a food product for cooking, and a conduit for providing gaseous communication outside of the cooking chamber, between the chamber bottom and the chamber top, the conduit also serving as a hot gas plenum. Preferably the conduit has a free volume of space less than the free volume of space of the cooking chamber, and the oven has custom cooking and/or custom finishing capabilities.

6 Claims, 6 Drawing Sheets

COMPACT QUICK-COOKING CONVECTIONAL OVEN

The present invention is a divisional application of U.S. patent application Ser. No. 09/199,902, filed Nov. 25, 1998, U.S. Pat. No. 6,060,701 and a continuation-in-part of U.S. patent application Ser. Nos. 08/863,671, filed May 27, 1997, U.S. Pat. No. 5,927,265; 09/053,960, filed Apr. 2, 1998, U.S. Pat. No. 5,990,466; 09/064,988, filed Apr. 23, 1998, U.S. Pat. No. 6,140,626 and 09/169,523, filed Oct. 9, 1998, U.S. Pat. No. 6,008,483.

BACKGROUND OF THE INVENTION

The present invention relates to an oven for cooking a food product in a residential oven, and more particularly to a residential oven which effects quick cooking of said food product.

McKee U.S. Pat. No. 5,254,823, U.S. Pat. No. 5,434,390, and U.S. Pat. No. 5,558,793, commonly owned by TurboChef, the assignee of the present invention and hereinafter referred to collectively as the "TurboChef Patents," are directed to quick-cooking ovens. The ovens described therein are primarily commercial ovens, partially because of the necessary size thereof, and partially because they lack features necessary in a residential consumer-operated oven (as opposed to an oven operated by a commercial employee). The TurboChef Patents are incorporated herein by reference.

As will be set forth below, for a wide variety of reasons adaptation of a commercial embodiment to a residential embodiment introduces many new problems which must be solved. For example, whereas a commercial establishment (such as a restaurant or a fast-food store) utilizes portion-control techniques to ensure that each portion of a particular food product is of generally the same size, weight, consistency, configuration and dimensions, in a residential setting, the oven will be subjected to large variations in the size, weight, consistency, configuration and dimensions of the food product. A successful oven must be capable of adapting to these varying factors. For example, a hamburger to be cooked in a commercial oven would typically be of the same size, weight and shape as the hamburger before and the hamburger to follow. On the other hand, in a residential oven the size, weight and shape of successive hamburgers may vary substantially such as a small, circular, thin hamburger of 0.3 pounds to a large, square, thick hamburger of 0.7 pounds. Therefore, "custom finishing" of the food product may be required.

Accordingly, it is an object of the present invention to provide an oven for quick cooking of a food product wherein the oven is suitable for residential use.

Another object is to provide such an oven which, in one embodiment, includes user-operable custom finishing means.

It is also an object of the present invention to provide such an oven which, in one embodiment, is sufficiently compact for residential use.

It is another object to provide such an oven which is easy and inexpensive to manufacture, use and maintain.

SUMMARY OF THE INVENTION

It has now been found that the above and related objects of the present invention are obtained in an oven for cooking a food product at least partially by hot gas flow. The housing defines a cooking chamber having a top, a bottom and a support means therebetween for receiving a food product for cooking, and conduit means for providing gaseous communication outside of the cooking chamber between the chamber bottom and the chamber top. The conduit means also serves as a hot gas plenum preferably enclosing a total free volume of space for air less than the total free volume of space for air of the cooking chamber. Associated with the cooking chamber are directing means adjacent to the chamber top for directing gas from the conduit means onto the food product in the cooking chamber, and return means adjacent to the chamber bottom for directing the return of the gas from the cooking chamber into the conduit means. Associated with the conduit means is a thermal energy source for heating gas disposed in the conduit means. The over further includes flow means for causing a flow of gas from the return means to the directing means via the conduit means, and control means for varying the effective volumetric flow rate of the gas flow into said cooking chamber and/or the temperature of the gas flow into the cooking chamber. The over further preferably comprises user-operable custom finishing means for causing custom finishing of an already cooked food product to further heat the food product, to further brown the food product, or a combination thereof and/or user-operable custom cooking means for causing custom cooking of a partially cooked food product by reducing further heating of the food product during the remainder of the cooking cycle, by reducing further browning of the food product during the remainder of the cooking cycle, or a combination thereof.

The oven additionally comprises microwave means for at least partially cooking the food product in the cooking chamber by microwave energy, user-operable input means for generically identifying to the control means the food product placed in the cooking chamber to be cooked, and means (e.g., a processor) for translating the user-operable means of identification into a generic cooking formula. The generic cooking formula specified the cooking parameters for all stages in the cooking cycle including the cook time for each event, the percentage of the cook time hot gas energy is used, and the percentage of the cook time microwave energy is used.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawings wherein:

FIG. 6*a* is a front elevational view of the display for custom finishing of an already cooked food product, while FIGS. 6*b* and 6*c* are front elevational views representing particular levels of finishing with settings entered by the user to increase the amount of browning and/or the amount of cooking (heating); and FIG. 7*a* is a front elevational view of the display for "custom cooking" the amount of a partially cooked food product, while FIGS. 7*b* and 7*c* are front elevational views representing settings entered by the user to reduce the amount of further browning and/or the amount of further cooking (heating).

DETAILED DESCRIPTION OF THE PREFERRED EMBODIMENTS

Figure 1:
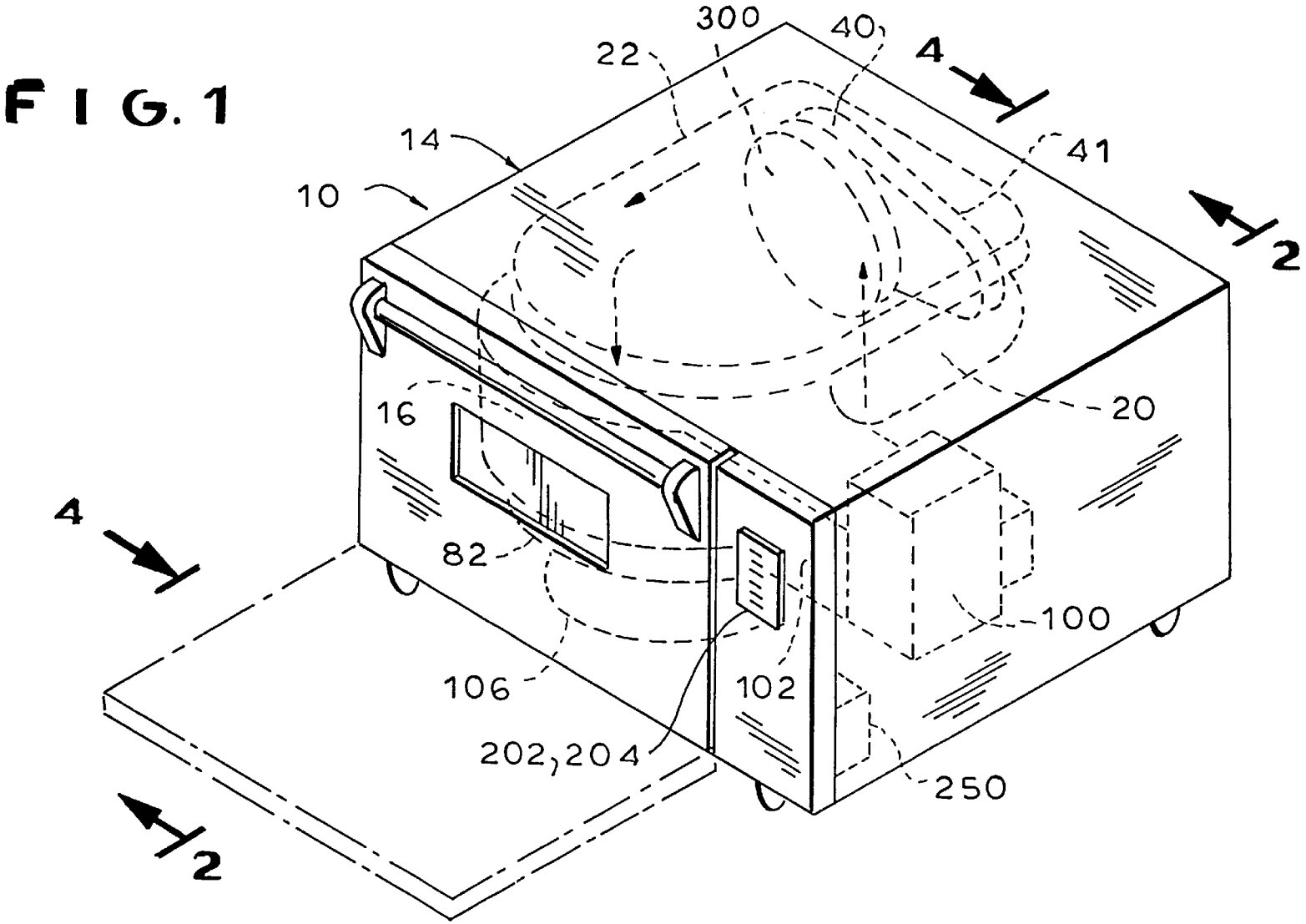
FIG. 1 is an isometric view of an oven according to the present invention.
Figure 2:
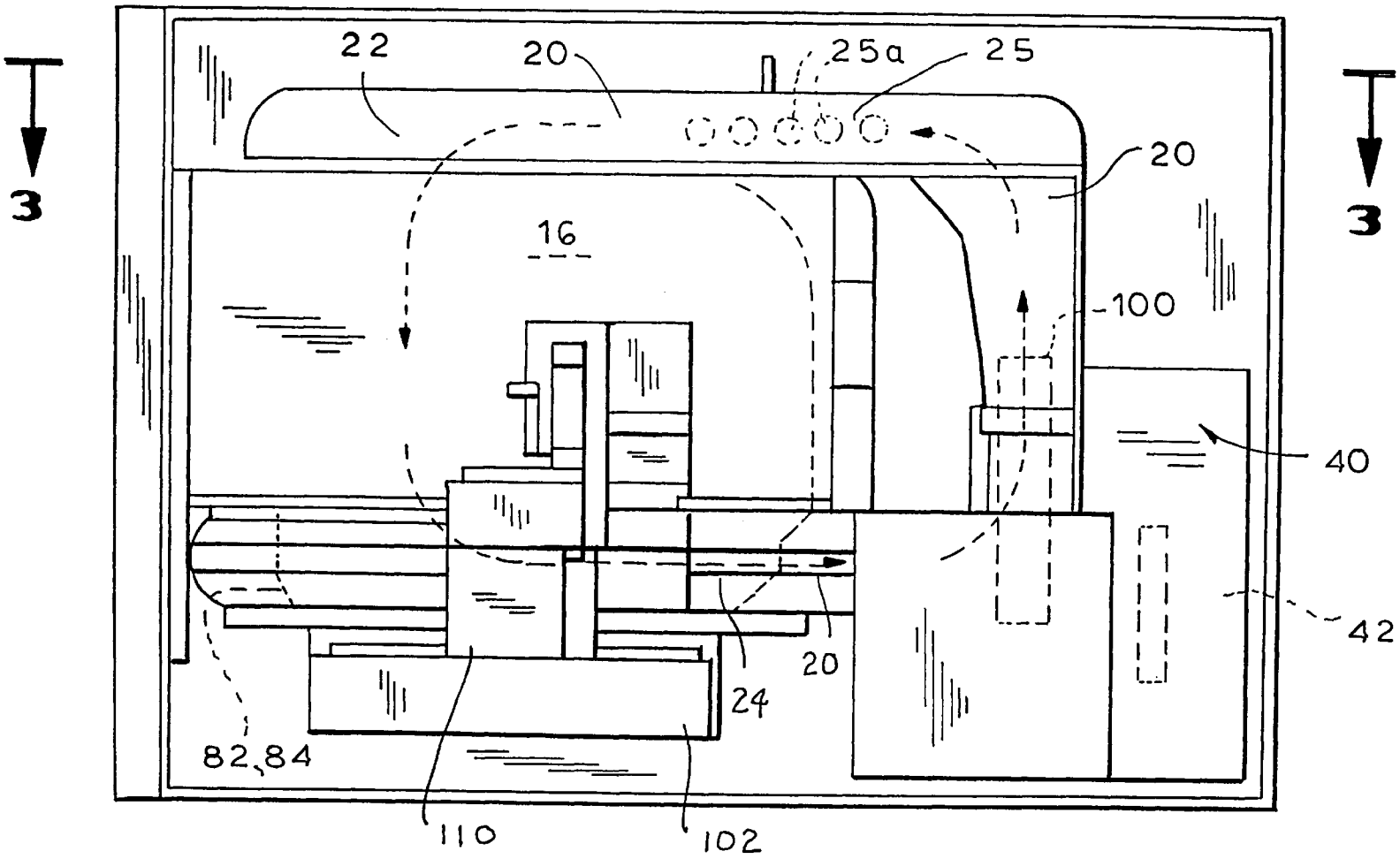
FIG. 2 is a sectional view thereof taken along the line 2—2 of FIG. 1.
Figure 3:
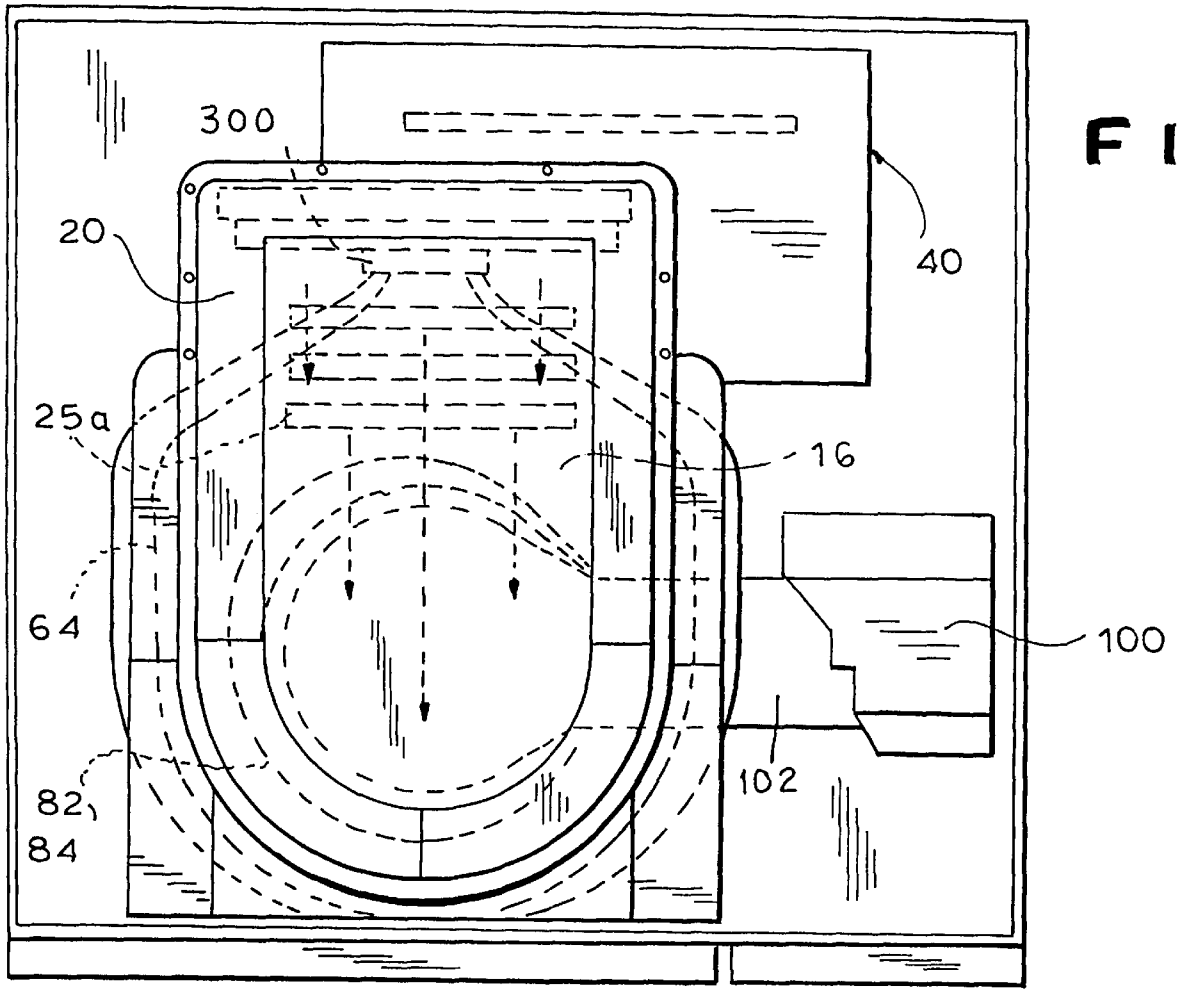
FIG. 3 is a sectional view thereof taken along the line 3—3 of FIG. 2.

While the present invention will be described in terms of a stand-alone or counter-top oven suitable for use in a residence, it will be obvious to those skilled in the cooking art that an oven according to the present invention may alternatively be a wall unit (incorporated into a wall such that only the front of the unit is exposed) or a console model having feet adapted to rest on the floor, or other variations thereof. Indeed, the residential oven may find utility in a commercial establishment, especially a relatively small commercial establishment, or other heretofore unanticipated locations.

While a commercial oven of the type described in the TurboChef Patents may have dimensions of 30"×30"×33", the dimensions of a preferred embodiment of a residential oven according to the present invention are a height of approximately 15 inches (excluding the additional 3 inches required for adjustable feet), a width of approximately 28 inches, and a depth of approximately 25 inches (excluding the additional approximately two inches required for the handle projection from the front of the unit). The weight of the 15"×28"×25" residential unit is approximately 140 pounds, substantially lighter than the 540 pounds of the 30"×30"×33" commercial oven described in the TurboChef Patents.

The reference numerals used herein generally correspond to those used in the drawings of the TurboChef Patents to indicate elements of similar structure or similar function.

Referring now to the drawings, and in particular to FIGS. 1–7 thereof, therein illustrated is a hybrid oven according to the present invention, generally designated by the reference numeral 10, for cooking a food product 12 (see FIG. 4) by both hot airflow and/or microwave cooking. The terms "air" and "airflow" are used interchangeably with "gas" and "gas flow" in this description unless otherwise noted. The oven 10 essentially comprises a housing generally designated 14, a cooking chamber generally designated 16 which is adapted to receive a food product 12 for cooking, and conduit means generally designated 20 for selectively providing a gaseous communication external to said cooking chamber 16, between the bottom and top of the cooking chamber 16. More particularly, the gaseous communication, or conduit means, 20 includes both an ingress conduit 22 (typically, but not necessarily, disposed adjacent the top of the cooking chamber 16) for the ingress passage of hot pre-cooking air into the cooking chamber 16, and an egress conduit 24 (typically, but not necessarily, disposed adjacent the bottom of the cooking chamber 16) for the egress passage of cooler post-cooking air from the cooking chamber 16. The airflow passes through a blower 40 to be discussed hereinafter, and may also pass through purification means 300.

It will be appreciated that the conduit means 20 also serves as a plenum of limited volume in that it contains (on an instantaneous basis) a small volume of air, typically hot air when the oven is in use. The "effective" plenum formed by the conduit means 20 is of substantially reduced volume relative to the plenum/reservoir described in the aforementioned TurboChef Patents. Thus, in the preferred embodiment of the present invention the cooking chamber 16 has a free or unoccupied volume for air of approximately 1600 cubic inches, and the conduit means 20 (from one end to the other) has a free or unoccupied volume for air of approximately 1100 cubic inches. Accordingly, in the present invention the free volume for air ratio of the conduit means to the cooking chamber is preferably less than 1, and optimally about 0.68. (By way of contrast, the TurboChef Patents teach a free volume for air ratio of the conduit means (plenum/reservoir) to the cooking chamber greater than 1, and preferably about 1.5).

The conduit means 20 has associated therewith and, as illustrated, preferably, but not necessarily, disposed therein, a thermal energy source 25 for heating "on the fly" the air disposed in the conduit means 20. The thermal energy source 25 is preferably a plurality of heating element 25*a* such as a series of parallel heating coils 25*a* (six coils being illustrated in FIG. 2), the number and power consumption of the coils being selected so as to be capable of providing the desired heating of the air passing through the conduit means 20 for entry into the cooking chamber 16. Preferably the heating means 25 is provided adjacent the top of the cooking chamber 16, but in or upstream of ingress conduit 22 leading into the cooking chamber 16.

A preferred thermal energy source 25 comprises a six-pass coiled wire having a wire diameter of 0.06 inch and constructed as an open-coil element made of nickel-chromium (Ni—Cr) resistance heating wire currently available from TutCo of Tennessee. During oven operation, the thermal energy source 25 operates at a temperature between 77° F. and 1800° F. At 240 volts AC power input, the total input power to the elements is about 6,000 watts. Maximum airflow across the thermal energy source 25 is about 3,000 cubic feet per minute.

While conventional wall outlets in U.S. residences provide about a 105–120 volt, single phase power supply, there are frequently dedicated outlets (such as required for a clothes dryer, wall oven, cooking range, or the like) which provide a 200–240 volt power supply, depending on the customary voltage of a particular country. Various countries operate with various power supplies, and the oven herein described is adaptable to such various power supplied. The oven 10 is capable of operating on a 200–240 volt power supply at 40 amperes or less, preferably at 30 amps or less. The energy output from the thermal energy source 25 is capable of meeting the thermal demand of the oven so that the temperature of the air entering the cooking chamber 16 may be maintained substantially constant at a pre-set level.

It will be appreciated that in the present oven one may vary not only the cooking time, and the microwave output level, but also the hot-air temperature (within limits) by controlling, over time, the power being introduced into the system for the generation of thermal energy. (By way of contrast, in the TurboChef Patents a hot air plenum/reservoir contained a high thermal mass heat exchanger which heated the airflow, thereby producing a hot-air temperature which was substantially fixed under normal conditions.)

As will be discussed hereinbelow, in certain instances the user of the oven 10 will be able to set the hot air temperature for a particular cooking cycle and, accordingly, means are provide to increase or decrease the temperature of the hot air entering the cooking chamber 16 so as to approximately match the cooking temperature pre-set by the user. This may be accomplished either by cycling the thermal energy source 25 on and off, or by maintaining the thermal energy source 25 on, but varying the power input thereto. The ability of the oven of the present invention to heat the air "on the fly"—without use of a separate, dedicated plenum/reservoir containing a large thermal mass (to absorb heat from a power source between cooks and to facilitate rapid heat transfer between the reservoir and the air within the plenum during cooks, as taught in the TurboChef Patents)—is a major factor in enabling the desired reduction in size of the present oven compared to the conventional commercial quick-cooking oven. For example, the thermal energy source 25 may be provided with an appropriate thermal heat source and a closely spaced series of thin fine, plates running parallel to each other, or tubular calrod elements. The thermal energy source is preferably disposed so as to maximize heat transfer to the air passing through the conduit means 20 while at the same time minimizing interference with the movement of air thereover. For example, the thermal energy source, when electrically energized over a short period of time, is capable of bringing the air within the conduit means 20 and the cooking chamber 16 (as well as the adjacent walls of the conduit means 20 and cooking chamber 16) to the desired operating temperature.

Operation of the thermal energy source 25 may be controlled by the control means 250 to be discussed hereinafter, including a thermostat and a cut-off switch which cuts off power to the thermal energy source 25 under at least two conditions. In the first condition, the power supply is being used for the magnetron or hot air blower, and there is insufficient power to enable the magnetron 100, hot air blower motor 40*a* and heating means 25 to be simultaneously operated. In the second condition, either the actual temperature of the thermal energy source 25 or the actual temperature of the air entering the cooking chamber 16 exceeds a "set" temperature. To this end, the thermal energy source 25 and the entry to the cooking chamber 16 are preferably provided with separate temperature-sensing mechanisms 30 and 30' (such as a thermocouple or resistive thermal device) positioned so as to measure the temperature of the air at these critical points.

A hot air blower assembly 40 is provided to circulate the air in the substantially closed air system defined by the cooking chamber 16 and the conduit means 20, while also providing the desired hot airflow onto food product 12. The blower assembly 40 typically includes a blower motor 40*a*, a blower wheel 40*b* within a blower housing 40*c* and a drive belt 40*d* connecting the blower motor 40*a* to the blower wheel 40*b*. While a blower assembly 40 which has the blower wheel directly secured to the blower motor (that is, without a drive belt therebetween) may be used, the type of blower utilizing a drive belt is preferred because it allows for relocation of the blower components so as to accommodate the limited available space within the oven housing. While a variable-speed blower (and more particularly a variable-speed blower motor) may be used, with the blowing motor being cycled on and off as necessary to provide the desired thermal energy for the cooking chamber, if desired, the conduit means 20 may be provided with dampers or louvers in order to modify the volumetric air flow through the conduit means 20 and thereby obtain the effect of a variable-speed blower while employing a fixed-speed blower.

The blower assembly 40 takes the spent or relatively cool hot air from the cooking chamber 16 via the egress conduit 24 and forces it through conduit means 20 for re-heating and re-circulation into the cooking chamber 16 via the ingress conduit 22. (As a safety precaution, the blower motor 40*a* is automatically deactivated when the oven door 80 to the cooking chamber 16 is open, thus precluding both accidents and the unintentional escape of heat from the oven through the cooking chamber door opening 16*a*.) The hot air passing through the ingress conduit 22 is made to flow against at least one surface of the food product 12 in the cooking chamber 16, as described hereinbelow.

Preferably a hot-air impingement technique is used wherein the hot air leaving the ingress conduit 22 passes through an inlet plate 55 having generally vertically disposed apertures 56 therethrough. The apertures 56 direct columnated flows of hot air downwardly into the cooking chamber 16, closely adjacent the upper surface 12*a* of the food product 12 therein. The columnated flows of hot air not only contribute to cooking of the food product upper surface 12*a*, but further act to sweep away the boundary layer of air at the food product upper surface 12*a*.

The production of columnated airflows directed for impingement upon a food product may be generated by conventional impingement tubes, by an inlet plate (as illustrated herein), or by like means. The principles of operation of hot-air impingement cooking are well known in the art and hence need not be described herein in detail. It will be appreciated by those skilled in the cooking art that other means for causing hot air to impinge upon the food product 12 in the cooking chamber 16 may be used. For example, a cyclone blower (not shown) may be used to create a cyclonic vortex within the cooking chamber cavity. As long as the food product is spaced above the cooking chamber bottom (e.g., the disk 110)—for example, by upstanding ribs—the cyclonic vortex will itself efficiently cook both the top and bottom surfaces of the food product 12 simultaneously. In this manner, a modified "shroud" effect is obtained without using an apertured platter for supporting the food product and for forcing the hot airflow over the food product bottom 12*b* by limiting the egress of the airflow. The upstanding ribs are preferably designed so as to maximize hot airflow intermediate the disk 110 and the food product bottom 12*b*.

Preferably the cyclonic air enter from a side of the cooking chamber 16 rather than the top or bottom thereof. The food product side adjacent the entry point of the cyclonic hot airflow is clearly cooked, but the opposite side (that is, the food product side remote from the entry point of the hot airflow) typically receives a somewhat lesser cook from the hot airflow.

A cyclonic vortex hot airflow system enables a more compact oven design (especially a shorter oven) and improved baking performance. While an air impingement system is available for many products, it is not the preferred method for baking products such as cakes, pies, and the like, as it tends to cook the delicate surface of the product too quickly, thereby creating surface ripples or creating a dot-like surface browning. Additionally, the air impingement geometry tends to increase the height of the oven for a given cooking chamber cavity size in order to accommodate the air ducts or conduits needed to produce the air impingement flow.

Thus, in order to create a more compact oven geometry and a better airflow pattern for preparing bakery products, a cyclonic vortex system is preferred wherein a very random swirling airflow pattern is created within the cavity that scrubs (rather than impinges upon) the surface of the food product. The random nature of the cyclonic vortex is required to insure that all surfaces of the food product experience the same time average set of heat transfer conditions.

The cyclonic vortex is developed by imparting a large swirl element to the hot airflow, the swirl action creating vortices within the cavity that tend to randomize airflow. The cyclonic vortex may be created by (a) a radial inflow of hot air into the cavity, horizontally aligned with the food product and adjacent the bottom of the cavity, with means of inducing the hot airflow around the food product and then out of the cavity, (b) a downward swirling hot airflow over the food product produced by fixed nuggets on the cooking chamber sidewall or (c) a downward swirling hot airflow produced by a blower wheel located over the food product so as to both cause the re-circulation of the hot airflow and the desired swirl of the hot airflow within the cavity. In this latter case, if desired, the thermal energy source may be disposed about the re-circulating blower. It will be appreciated that where the cyclonic vortex is utilized in connection with ribs for supporting the food product bottom above the cooking chamber bottom so as to define an airflow passage therebetween, as earlier indicated the apertured platter is not necessary in order to insure conductive cooking of the food product bottom surface.

While the inlet to the egress conduit 24 has been illustrated as centrally vertically aligned within the cooking chamber 16 (that is, along a central vertical axis thereof), in point of fact the inlet to the egress conduit 24 may be substantially horizontally offset therefrom. In this case, the air which passes through the platter 64 undergoes a change in flow direction above the basket 84 such that the downwardly directed air stream may enter the inlet of conduit 20 via the screen 82. Placement of the entrance to egress conduit 24 at a point horizontally displaced from the central vertical axis extending through the cooking chamber 16 and the launcher 106 (26) has the advantage of minimizing any harmful influence of one system (for example, the microwave or hot air system) on the other system (for example, the hot air or microwave system). Indeed, in a cyclonic vortex oven the entrance to the egress condition 24 may be disposed not underneath the cooking chamber bottom at all, but rather in the surrounding cooking chamber sidewall at an appropriate height above the cooking chamber bottom.

It will be appreciated that, in order to provide a vertically more compact oven, the oven of the present invention does not employ the "diffuser" taught by the TurboChef Patents.

A refractory platter 64 of microwave-transparent and heat-resistant material (such as a metal oxide or ceramic) defines a plurality of upwardly extending bosses 67. The platter 64 is supported by a platter support (not shown) which may extend inwardly from the oven door 80 and acts as a food support. The main body of the refractory platter (excluding the bosses 67) is disposed in close but spaced relationship to the bottom surface 12*b* of the food product 12 (illustrated in phantom line in FIG. 4), which is supported on bosses 67. Intermediate the bosses 67, the main body of the platter 64 defines a pattern of apertures 66 therethrough so as to enable the spent, relatively cool air to leave the cooking chamber 16 adjacent the bottom thereof. As the platter 64 preferably extends essentially the full diameter of the horizontal plane of the cooking chamber 16 in which it is disposed, the apertures 66 thereof constitute the only passages through which the spent air can escape the cooking chamber 16 and pass back into the conduit means 20. The exact diameter of each aperture 66 is determined by experiment with the intention of uniformly distributing the air flow from the inlet plate 55 through the various apertures 66.

In particular, the cooking chamber 16 is substantially air-tight (when the door of the oven is closed) so that substantially all of the air passing from the ingress conduit 22, through the air inlet plate 55, and onto at least a first surface 12*a* of the food product 12 (here, the top surface), reaches the egress conduit 24 only after at least a portion thereof passes across the remaining portion of the first surface 12*a*, and across a substantial portion of a second surface 12*b* of the food product 12 (here, the bottom surface) opposed to the first surface 12*a*. Thus, as illustrated, most of the air from the food product top surface 12*a* is forced to pass over the food product sides, and at least a portion thereof is forced to pass over the entire radius (or a substantial portion thereof) of the food product bottom surface 12*b* before the air reaches the egress conduit 24. To this end, the apertures 66 of the platter 64 are sized to restrict the amount of hot air that can pass downwardly through each aperture so that, before existing, the cooking chamber hot air passes over a substantial portion of the food product bottom surface 12*b* before it can emerge on the bottom side of the platter 64.

Figure 4:
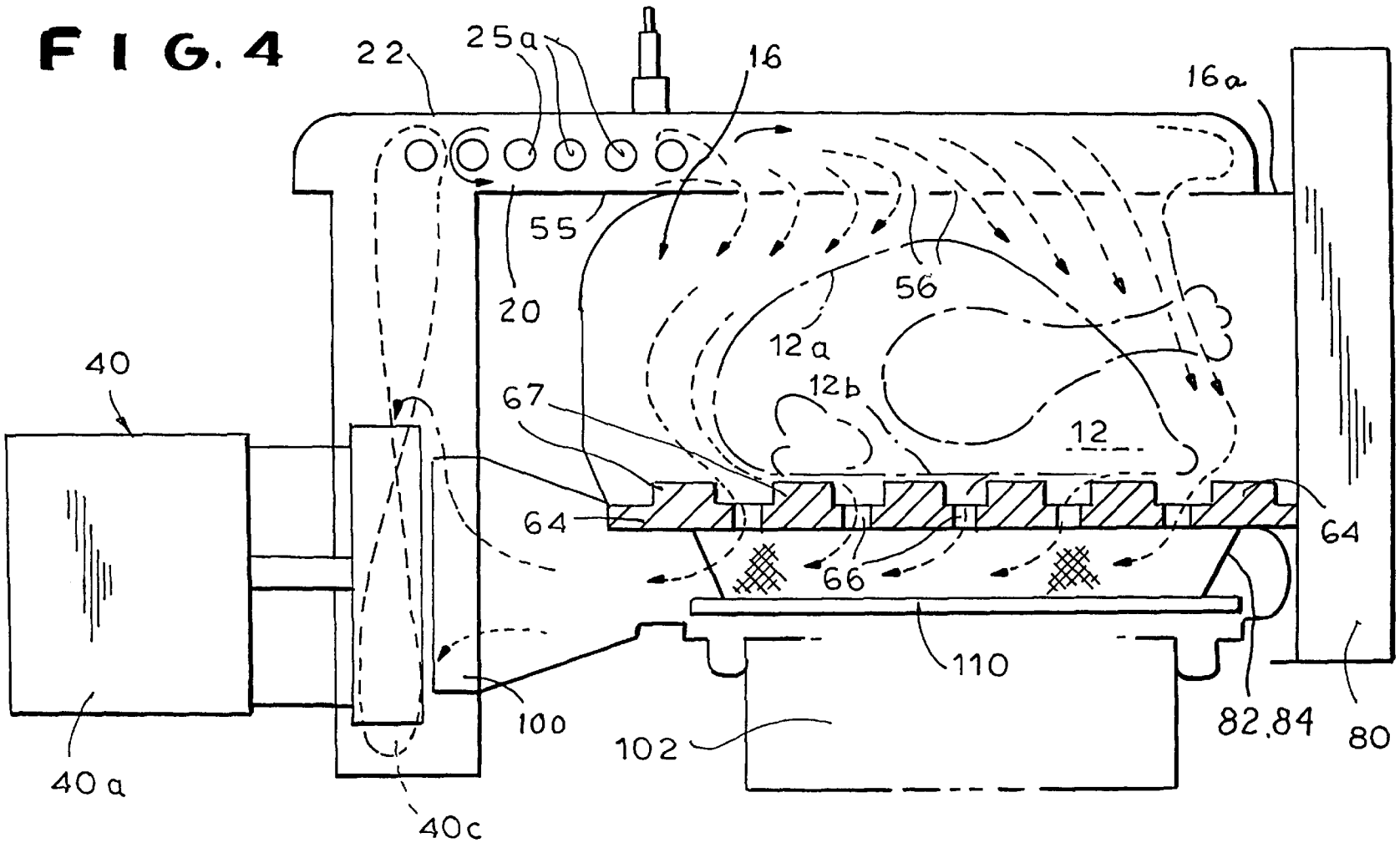
FIG. 4 is a sectional view thereof taken along the line 4—4 of FIG. 1.
Figure 5:
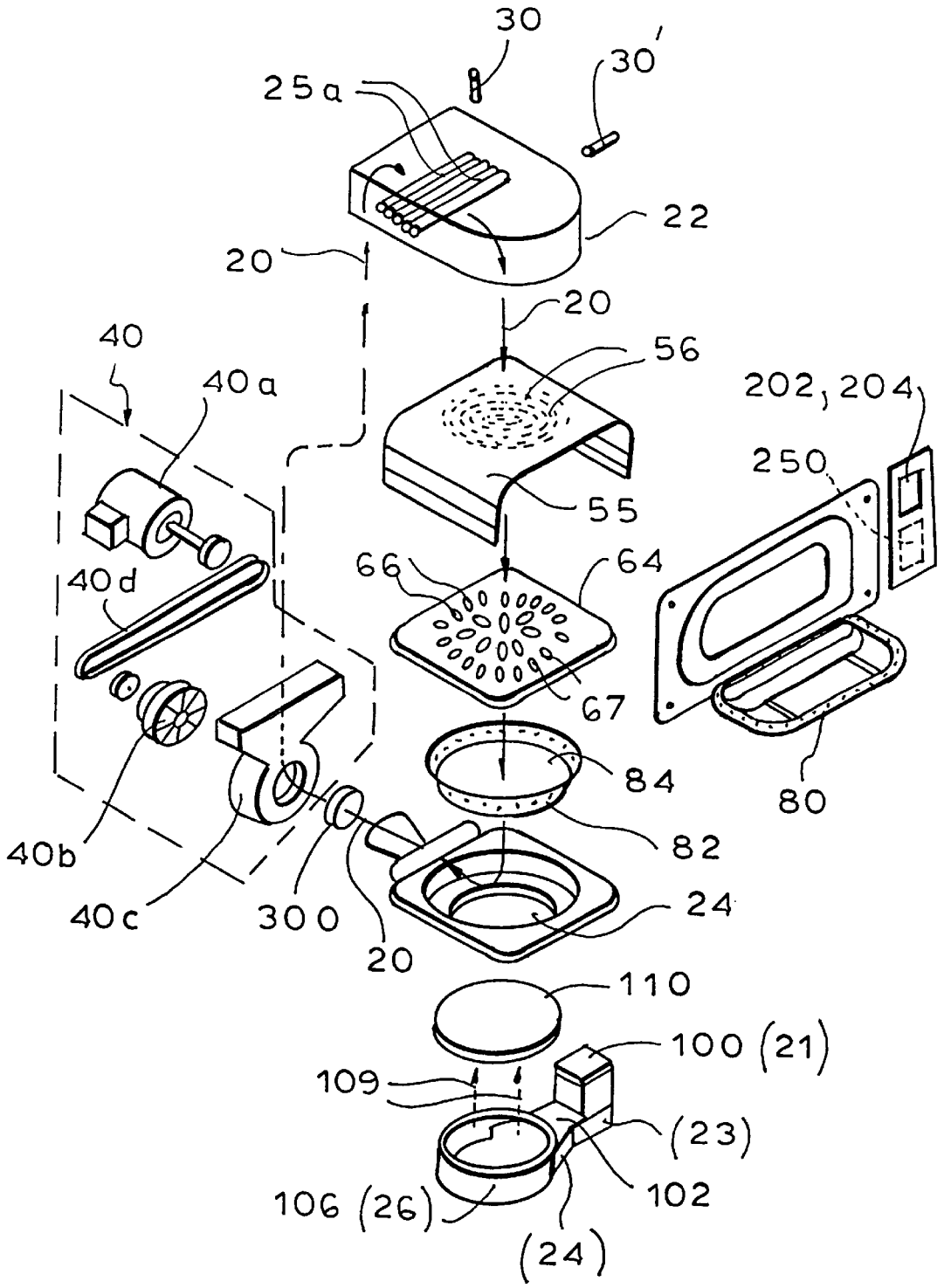
FIG. 5 is an exploded isometric view of the basic components thereof.

More particularly, the hot air leaving the inlet plate apertures 56 strikes the food product upper surface 12*a* in areas more or less aligned with the air inlet apertures 56. Most of the hot air which contacts the areas of the food product 12 aligned with the apertures 56 is drawn radially outwardly across the upper surface 12*a* of the food product and downwardly around the sides of the food product so that the hot air passes over the areas of the food product upper surface 12*a* which are not aligned with the apertures 5. The still-hot air traveling radially outwardly over the non-aligned areas is in heat-transfer relationship with such non-aligned areas so that a generally uniform cooking of the entire food product upper surface 12*a* is achieved without any relative movement of the apertures 56 of the food product 12. (See broken line arrows of FIG. 4 representing the hot airflow about the turkey-like food product 12.) The upper surface of the platter 64 intercepts the still-hot air (at least some of which has passed over the top surface 12*a* and sides of the food product 12) and prevents it from leaving the cooking chamber 16 until at least a substantial portion of the still-hot air has passed radially inwardly, intermediate the food product bottom surface 12*b* and the upper surface of the planar 64 in heat-transfer relationship with the food product bottom surface 12*b*. During its passage along the food product bottom surface 12*b*, the hot air is cooking the food bottom surface 12*b*, thus providing enhanced cooking thereof. The now relatively-cool "hot air" passes through the apertures 66 of the platter 64 and departs from the cooking chamber 16.

The exact fraction of the entering hot air which passes along various portions of the food product bottom surface 12*b* before reaching an available platter aperture 66 which is capable of accommodating it (that is, an aperture 66 which is not already at its full air-flow capacity) will be determined by a number of design features of the oven (and thus set by the manufacturer) as well as a number of operational features (and thus set by the user). As an example of the design features, the appropriate spacing between the food product bottom surface 12*b* and the upper surface of the platter 64 is selected so as to achieve maximum cooking of the food bottom surface 12*b* without unduly limiting the flow of air through the oven. Preferably the height of the bosses 67 is small so that the velocity is relatively high and therefore sweeps away from the boundary layer about the food product bottom surface 12*b* (much as the impinging air sweeps away the boundary layer of the food product upper surface 12*a*). To maximize heat transfer to the food bottom surface, the height of the bosses 67 should be as low as possible without restricting airflow. Conversely, to reduce heat transfer to the food bottom surface 12*b*, the height of the bosses 67 should be increased to bring less of the hot air stream into contact with the food product bottom surface 12*b* (due to more volume between the top of the platter 64 and the bottom of the food surface 12*b*). Other design features would include the size and spacing of the platter apertures 66.

User-determined features affecting the air flow include the configuration and dimensions of the food product or products 12 placed on the bosses 67 of platter 64, and the degree to which the food product(s) substantially cover the platter apertures 66. Ideally, in the absence of any food product 12 in the cooking chamber 16, most of the air passing downwardly from the ingress conduit 22 via the plate apertures 56 passes more-or-less directly through the platter apertures 66 with only minor directional deviations, such that the platter 64 does not represent a bottleneck for airflow. In other words, the combined cross-sectional areas of the platter apertures 66 is just sufficient to accommodate the combined cross-sectional areas of the hot air jets leaving the inlet plate apertures 56. Because the individual platter apertures 66 not covered by a food product or products are substantially fully occupied by the air impacting on the same via a vertically aligned (or close to vertically aligned) air inlet apertures 56, the downwardly directed hot air stream impinging on the food product upper surface 12*a*, and then passing along the food product sides, will find available only the platter apertures 66 disposed below the food product(s). Accordingly, the "shroud" effect described in the TurboChef Patents—whereby the hot air initially impinging on selected areas of the food product is thereafter forced into and maintained in heat-transfer relationship with other areas of the food product so that the remaining heat value of the hot air is efficiently used to heat the other areas of the food product as well—is achieved by the platter 64 without forcing all of the airflow to pass radially inwardly until it can depart through a relatively large central aperture of the platter.

Before the air leaving the platter apertures 66 passes through the egress conduit 24 of conduit means 20, it is at least somewhat cleaned by passage through conventional filter means for cleaning the air stream of particulate matter and/or grease which may result from the handling or cooking of the food product 12 within the cooking chamber 16. A preferred filter means comprises a perforate basket 84 for collecting the large solid by-products of handling and cooking the food product 12, and a cylindrical mesh filter 82 secured to the periphery of the basket 84 for movement therewith as a unit, the filter 82 being disposed about and around the basket 84 for collecting the smaller solid by-products.

Those skilled in the oven art will readily appreciate that, where appropriate for the particular food products to be cooked, the entire operative configuration of the oven can be inverted so that the hot air inlet plate 55 is disposed below the food product 12, so as to directly force the hot air upwardly against the bottom surface 12*a*, so as to force the hot air to then flow to across a portion of the diameter of the food product top 12*a*.

Turning now to the microwave-cooking feature of the present invention, microwave ovens are well known in the art and hence need not be described in great detail herein. As described in McKee U.S. patent application Ser. No. 09/053,960 (using the reference numerals from that application in parentheses), a single magnetron 100 (21) is disposed so that the microwave output therefrom is discharged via a horizontal waveguide (23) to a quarter-wave matching waveguide (24), then directly into a vertically oriented circular launcher 106 (26). Because the height of the circular launches 106 (26) of the present invention is thus decreased, the overall height of the microwave system is thereby reduced, resulting in a more residential oven. The circular launcher 106 radiates the microwave energy upwardly towards the platter 64 and the food product 12, as illustrated by the broken line arrows 109 of FIG. 5. The magnetron system is provided with a heat seal or barrier 110 so that the hot air from the cooking chamber 16 cannot enter the magnetron/waveguide system. The heat seal or barrier 110, is formed of a microwave-transparent and heat-resistant material, such as ceramic, quartz, or other suitable material.

In order to meet the very stringent space requirements of a residential oven, the magnetron and waveguide are preferably rotated from the horizontally facing orientation disclosed in McKee U.S. patent application Ser. No. 09/053,960 to a downwardly facing vertical orientation wherein the magnetron may be horizontally aligned with the circular waveguide, as disclosed in McKee et al. U.S. patent application Ser. No. 09/169,528. If desired, the microwave energy system may be inverted so that the microwave energy is projected downwardly, or divided, with a portion thereof being fed upwardly and a portion thereof being fed downwardly. Indeed, if desired, the microwave launcher 26 may launch the microwave energy at the food product from the sides thereof rather than, or in addition to, the bottom thereof, or the top thereof, or both.

An exothermic catalytic converter 300, similar to the one disclosed in McKee U.S. patent application Ser. No. 08/863,671, is preferably employed to remove airborne grease from the airflow. The removal of airborne grease and other hydrocarbons from the airflow by exothermic catalytic means helps to reduce the energy level requirements of the oven as the air passing over such catalytic converter 300 increases in temperature by, in some instances, as much as 250° F. Additional heating means (not shown) for the airflow may be provided upstream of the catalytic converter 300 to further ensure that the temperature of the airflow entering the catalytic converter is high enough to produce the desired catalytic reaction. Accordingly, such an auxiliary heater would typically be activated only intermittently.

In order to eliminate the need of a catalytic converter housing of substantial bulk within the confines of a residential oven, additional catalytic material may be disposed, in addition or alternatively, as a coating on the interior surface of the conduit means 20 or other interior oven surfaces, thereby to further increase exothermic catalytic activity. As interior coating of surfaces with exothermic catalytic material is known to those skilled in the art, further discussion and description thereof is not presented herein.

The pre-set temperature of the hot air (whether set by the user or by a generic cooking formula) tends to be in range of 275° F. to 545° F. The capacity of the thermal energy source 25 to increase the temperature of the air flow, thereby to meet the requirements of a pre-set temperature (determined either by the use for particular cooking formulas wherein the user has that option or by the system through its generic cooking formulas), is, for practical purposes, instantaneous. On the other hand, the ability of the oven to cause the airflow to rapidly drop its temperature simply through de-activation of the thermal energy source 25 is limited. This is an especially important consideration in a residential oven where the user is given the option for setting a pre-set temperature for a given cooking operation and a particularly low temperature is set immediately after a particularly high temperature operation. Accordingly, the rapid air temperature modification system disclosed in McKee, U.S. patent application Ser. No. 09/064,988 may be employed, as necessary, to reduce the temperature of the airflow entering the cooking chamber 16.

Preferably the control means 250 periodically actuates the blower assembly 40 to circulate air to preheat and then to maintain the cooking chamber 16 to at least a predetermined minimum temperature between cooking cycles. For example, during the preheat stage, or at fixed time intervals thereafter (say, of about a minute), or whenever the cooking chamber thermocouple 30 indicates that the cooking chamber 16 is below a predetermined minimum temperature, thermal energy source 25 and blower assembly 40 may be activated so that hot air from the conduit 20 brings the temperature of the cooking chamber 16 above the predetermined minimum temperature, thereby to ensure that the next food product 12 is, in effect, placed in a pre-heated cooking chamber 16.

Referring now to FIG. 1 in particular, therein illustrated is the oven front including a hinged door 80 for closing the cooking chamber opening 16*a* and a stationary control panel, generally designated 200, which includes a display 202 such as an LED panel, a data entry system 204 such as a touch-sensitive screen, and various optional switches. Control means 250 determines constant operation or cycling of a fixed-speed blower (or control of louvers and doors where these are used to control the air flow in a fixed-speed blower configuration), selected variation of a variable speed blower 40*a* when present, the thermal energy source 25, and the magnetron 100. The operator interface with the control means is similar to that used in the commercial ovens of the TurboChef Patents. In view of the wide range of foods which may be cooked in a residential oven, and the limited space in which to provide an identification of the foods (on the front of the oven) and to communicate to the control unit 250 which food product is to be cooked, a relatively small LED or computer-like screen may be employed with extensive use of drop-down screens or menus.

Thus an initial "Oven" window may provide—for example, on the display 202—the following oven options: Turbocook, Microwave, My Recipes, Defrost, Clean, Setup. The user then selects the desired Oven option—for example, by pressing pressure-sensitive screen 204. Purely by way of illustrative example, selection of the Turbocook option will cause a drop-down screen displaying the Turbocook procedures as follows: Bake, Roast, Broil, Toast, Oven Crisp. Selection of the Bake option will result in a drop-down screen display for "Bake What?" as follows: Casserole, Pizza, Baked Goods, Meats, Vegetables. (Selection of the "Roast" option of the Turbocook drop-down screen will result in the opening of a "Roast What?" drop-down screen specifying: Beef, Pork, Poultry, Vegetables; etc.) Selection of the Meats option would result in a drop-down screen for "What Type?" as follows: Beef, Pork, Poultry, Fish. A selection of any of these options would cause a "Bake Temperature" drop-down screen to appear which would offer a selection of temperatures at which to bake the food product. The user has the option of setting the pre-set temperature for Bake and Roast, but the oven is "pre-set" for Broil at 500° F., for Toast at 450° F. and for Oven Crisp at 450° F.

Note that if the selected temperature is not within a predetermined range of the current oven temperature (for example, within 25° F. to 30° F.), the control unit will recognize that a "pre-heat" or "cool-down" period may be required before actual cooking of the food product commences. During the pre-heating or cool down stage the display will preferably instruct the user to wait to place the food product in the oven until the oven either warms up or cools down to the pre-set temperature. When the pre-set temperature has been reached, or almost reached, the control unit will then display the temperature and indicate that it is ready to have food placed in the cooking chamber.

Regardless of the selected "Turbocook" option, the control unit will require input from the user as to the total cooking time. The duration of stages in the cooking cycle (according to the generic cooking formulas) are calculated as percentages of the total cooking time set by the user. It will be noted that each cooking cycle (the amount of time necessary to cook a food product) is divided into at least one and potentially an infinite number of cook stages.

The use of staged inquiries through drop-down screens and menus in a computer is well-known and hence need not be set forth herein in further detail Among its many other features, the control unit 250 preheats the oven immediately upon the oven being turned on. The preheat period is about twelve minutes for a 110 volt system and about 6 minutes for a 240 volt system.

The available cook programs are grouped by profiles, each profile including a generic cooking formula suitable for a particular type of cooking of a particular food product. Each profile contains a number of stages or events in the cooking cycle which are run for a predetermined percentage of the total cook time. The percentage of maximum capacity for the blower assembly 40 and the magnetron 100 is given separately for each stage. Accordingly, the generic cooking formula utilized for each stage of a profile is dependent upon the user setting of time and, in the case of baking and roasting, upon the user setting of temperature as well.

It should be appreciated that the temperature at which the hot air cooks (browns) a food product in any given stage or event of the cooking cycle is not necessarily exactly the temperature set by the user. Each stage or event may be a temperature relative to the user-set temperature—for example, 20° F. higher or 30° F. lower.

Once the food product has been cooked according to the generic formula, the residential oven affords the user the option of specifying that the particular food product then in the oven should be further cooked (by microwaves alone), further browned (by hot air) or both cooked and browned (by further microwave and hot air cooking). For pedagogical purposes the cooking (heating) effect of the hot air used for browning will be ignored.

"Custom finishing" refers to the ability of the oven user to vary individually and independently the amount of hot air cooking (that is, the cooking which both heats and browns the food product) and the amount of microwave cooking (that is, the cooking which heats the food product without browning it). The custom finishing may be necessitated by variations in the size, shape or weight of the food product actually being cooked from the theoretical norm upon which the cook settings are based. On the other hand, the custom finishing may simply be required because of individual preferences—e.g., a given user's preference for heavily browned food products, for extremely hot food products or even extremely hot and heavily browned food products.

A wide variety of different means may be employed to achieve the custom finishing. In the preferred embodiment, once the cooking according to the generic cook program profile has been completed, the user may be asked whether additional heating, additional browning, or both are desired. For example, an appropriate message may be displayed on the LED screen 202, with the user being able to select more browning or more heating, or both, simply by appropriate touches on a touch-sensitive screen 204. In a somewhat simplified version, there may be rotary knobs which the user can rotate to communicate the same information, or even pushbuttons with each actuation of a pushbutton being used to increase the amount of additional browning or the amount of additional heating.

The basis for the increased in browning time or cooking (heating) time is preferably in terms of the blower capacity or microwave capacity of the oven. Thus, more browning can be achieved by adding hot air in fixed increments of the blower capacity (e.g., 20%, 40%, 60%, 80%, etc.) for a predetermined time. Similarly, more heating can be achieved by adding increments of the microwave capacity (e.g., 33%, 50%, 100%, etc.) for a predetermined time. For particular applications, it may be desirable for the user to have the option of setting the temperature of the additional hot air to be used, if it to be varied from the initial hot air temperature initially designated by the user. Also in particular applications, it may be desirable for the user to have the option of setting the time during which the additional hot air or microwave cooking will be performed. It will be appreciated that a modification of the hot air or heat energy being supplied requires consideration of both the time during which it is to be supplied and the percent capacity of the blower utilized to supply it, as well as the temperature at which it is to be supplied. Similarly, the modification of the microwave energy to be supplied requires consideration of the time during which it is to be supplied and the percentage of the magnetron capacity utilized to supply it. The ability of the oven to enable separate modification of the thermal energy and microwave energy enables a broad range of user preferences to be accommodated, as well as a wide variety in the size of the food product(s) to be cooked. The versatility of the oven according to the present invention is therefore not found in prior art commercial ovens which enable the cooking cycle—with its predetermined settings for thermal energy and microwave energy—to simply be extended for a given period of time (e.g., in either absolute terms or as or a percentage of the last cooking event), rather than enabling separate and independent control of the heating and browning functions as in the present invention.

The "custom finishing" operation described hereinabove refers to adjustments that are made by the user to an already cooked food product (i.e., one which has already undergone a completed cooking cycle as determined by the appropriate generic cook formula) but does not address the cooking of a food product which is to be cooked with less than the amount of heating and/or browning specified by the generic cook formula. To this end, the control unit 250 may be programmed to advise the user when the cooking cycle is partially complete (e.g. 75% of the way through the total cook time) and then provide the user with the option of determining by inspection the state of the food product in the oven (by pausing the cooking cycle) and adjusting independently for less browning through the remainder of the cooking cycle, less heating through the remainder of the cooking cycle, or both, through an interface system similar to that used in the "custom finishing" operation. Depending upon the particular application desired, the reduction can be in terms of a percentage reduction in the browning time or heating time remaining, or it can simply alter the percentage of blower capacity or microwave capacity utilized in the remaining stage(s). This adjustment of the cooking cycle or profile by the user is referred to as "custom cooking" as it is performed upon an only partially cooked food product.

It is desirable that the user have the opportunity to store the modified generic cooking profile resulting from the use of the generic cooking formula plus the "custom cooking" and "custom finishing" operations (or at least the "custom cooking" operation) so that it may be used again if the modified cooking profile produced a satisfactory product. To this end, the control unit can add an entry which contains the parameters for the modified cook to the "My Recipes" memory of the oven.

Figures 6A, 6B, 6C:
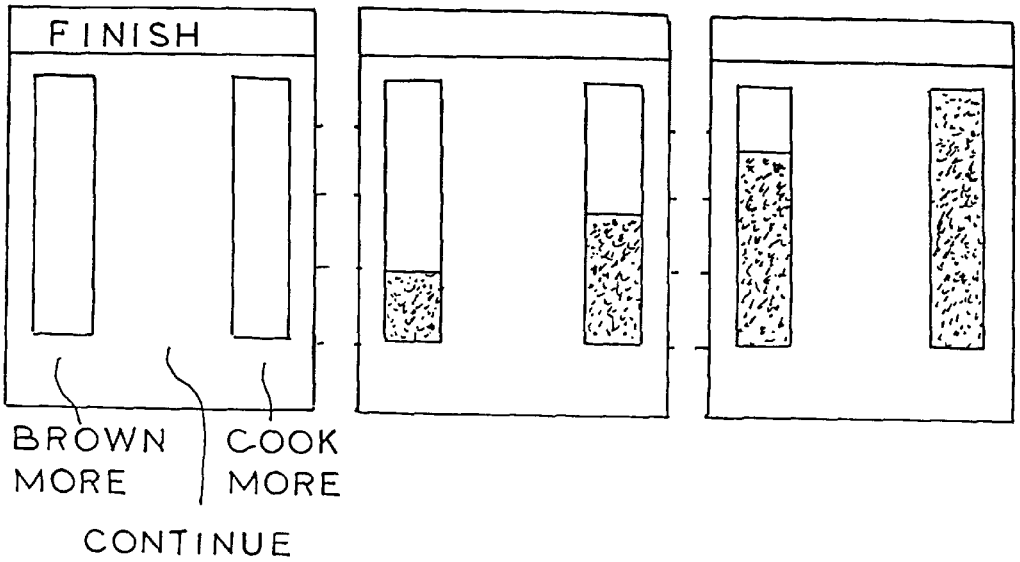
Figures 7A, 7B, 7C:
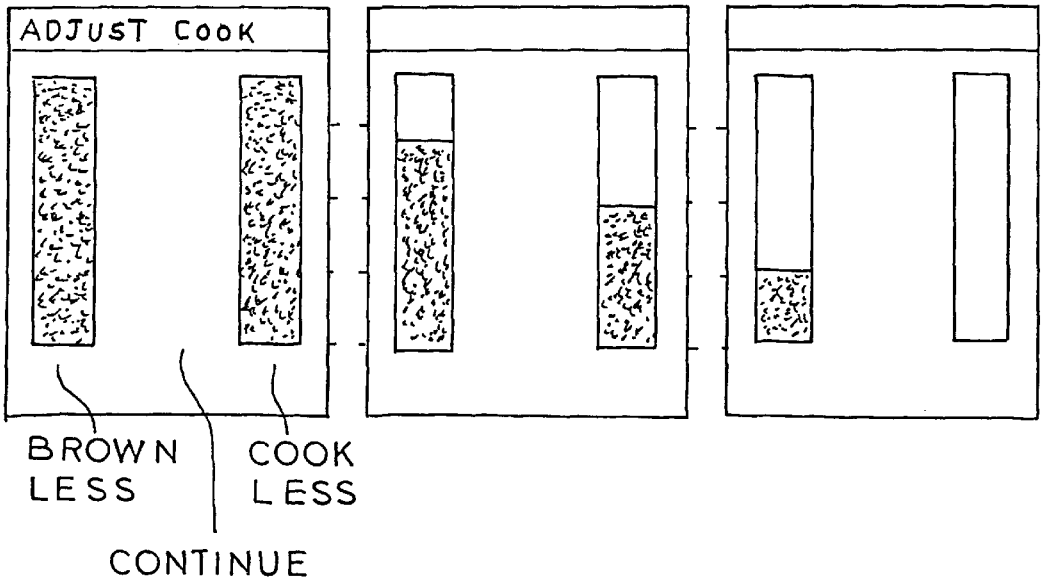

Referring now to FIGS. 6*a* and 7*a*, therein illustrated are specimen displays for communicating to the user the option for custom finishing and custom cooking, respectively. While the displays are illustrated as being vertical bar charts, clearly other configurations (such as cones) may be utilized. In the initial custom finishing display illustrated in FIG. 6*a*, both bars are initially set at 0%. FIGS. 6*b* and 6*c* represent different alternative selections which may be made by a user in order to provide custom finishing. FIG. 6*c*, in particular, shows that substantially more "finish off" is preferred and, in particular, that the cooking (heating) is to be maximized (at 100%) and the amount of additional browning desired is approximately 80%. If still further finish off is desired, once the additional cooking has been completed, the initial display of FIG. 6*a* may be provided once again to enable the user to select even further finish off by more hot air, more microwave, or both.

FIGS. 7*b*–7*c* illustrates possible user settings for custom cooking. As previously described, at approximately 75% of the way through the cooking cycle, the oven displays a message to the user to check the food product. At this point the user has the opportunity to cook less aggressively through the remainder of the cooking cycle, by reducing the amount of hot air, reducing the amount of microwave energy, or reducing both hot air and microwaves. In the initial custom cooking display illustrated in FIG. 7*a* both the hot air and microwave energy bars are pre-set at 100%. If, for example, the user desired less browning and less cooking through the remainder of the cooking cycle, the user might choose settings as represented in FIG. 7*b*. FIG. 7*b* depicts the settings wherein the user has adjusted the remaining cooking by reducing the hot air to energy approximately 80% and also reducing the amount of microwave energy to approximately 50%. By way of example, the user could have alternatively adjusted the cooking paradigm as depicted in FIG. 7*c* wherein the further amount of hot air has been reduced to approximately 20% and the further amount of microwave energy has been reduced to zero. FIG. 7*c* therefore depicts a scenario wherein no more cooking will occur by microwave and only a little more browning will occur for the remainder of the already set cooking time.

As earlier noted, depending upon the programming of the control unit, the additional browning or cooking (heating), through the remainder of the cooking cycle, may be in terms of a fixed period of time, a percentage of the total cook time, a percentage of the cook time in the last stage of the generic cooking formula, the percentage of blower capacity or magnetron capacity, or the like.

While the cooking chamber 16 is illustrated as being box-like, and, more particularly a rectangular parallelpiped (i.e., having a rectangular cross-section), preferably the cooking chamber of cooking cavity has a configuration which is either cylindrical or conical. A box-like cavity creates non-uniform cavity heating as a result of the corners creating asymmetric heating conditions. Thus in a convection oven, the corners create zones within the cavity which may be characterized either as low airflow zone or excess airflow zones. In the low airflow zones the hot air tends to stagnate with the results that the food product within such a zone is undercooked, and in the excess zones, the airflow is higher than in the rest of the cavity and tends to overcook the food product within such a zone. Oven designs have been implemented in the prior art to create a more uniform time-averaged set of hot airflow conditions, e.g., designs using airflow baffles and the like. However, the changes affected by these means tend to be very food product specific and do not represent a solution for all cooking conditions. In a similar manner, in a microwave oven the microwave energy distribution is affected by the corner boundary conditions, thereby resulting in hot spots and cold spots within the cavity. Oven designs have been implemented in the prior art to eliminate the impact of cavity corners and their affect on the microwave energy distribution, e.g., designs using mode stirrers, rotating platters and the like. However, none of these design changes restores a uniform microwave energy field in a box-like cavity.

Accordingly, in a preferred embodiment of the present invention the oven has a cylindrical or conical cavity 16 which is in effect cornerless, thereby eliminating the corner boundary conditions that result in a non-uniform energy transfer (whether it be hot air or microwave energy). The cylindrical or conical cooking chamber produces a uniform cook which is relatively insensitive to the particular food product type being cooked.

While the conduit 20 has been described herein and above as a separate physical entry from the cooking chamber 16, those skilled in the oven art will recognize that, at various points within the oven, the cooking chamber 16 and the conduit means 20 may share a common wall, thereby to enable a more compact and less expensive oven. On the other hand, where the temperature difference between the airflow in the conduit means 20 and the airflow in the cooking chamber 16 is so extreme that the cooking of the food product in the cooking chamber would be adversely affected thereby, the adjacent wall portions of the cooking chamber and the conduit may be spaced apart, with thermal insulation optionally being placed in the space thus formed.

While the herein described embodiment of the present invention utilizing an electric thermal energy source is preferred, alternatively the energy source for the convective heat transfer mode could be natural gas, propane or a like combustible material. From an overall operating energy cost stand point, the natural gas or similar gas fuel is the preferred energy source. In addition, for those residential installation where electric service to the kitchen is inadequate for powering all aspects of the oven (that is, both the microwave and convector thermal heating), a natural gas or propane fueled heating system may be an option.

Clearly the natural gas fired convective heating subsystem must be capable of providing rapid heating while also being suitable for a microwave environment. Preferably the natural gas fired convective heating subsystem further minimizes or eliminates contacts of the products of combustion (of the natural gas) with food products. For example, when the products of natural gas combustion contact certain meats, a surface pinkness of pink discoloration may be observed in the cooked meat and may be misinterpreted by consumers as an offensive level of undercooking. It is believed that the products of combustion (i.e., carbon monoxide and nitric oxide) react with the myoglobin in the meat to create the pink surface condition.

Accordingly, an indirect fired convective system, wherein the combustion products do not contact the food product, is preferred for its high speed and high quality cooking, over a direct fired system, wherein the combustion products transfer their heat directly to the food product. In the indirect fired conductive system, heat from the combustion products is transferred via heat exchanger elements to the oven airflow, thereby isolating the products of combustion from the cooking cavity and eliminating several issues associated with the direct fired or conductive system (including the need to substantially increase the vent size of the oven cavity to accommodate the flow of the combustion products therethrough and to avoid incompatibility with a microwave environment). The indirect fired conductive system preferably is compact, has a short ignition cycle (e.g., about three seconds), and utilizes a lightweight heat exchanger for quick response in a high speed oven. To accomplish these goals, a fully premixed powered combustion system, including a thin walled stainless steel heat exchanger, is preferred.

In order to provide a more compact oven suitable for residential use, the commercial oven described in the TurboChef Patents has been modified as follows:

1. A separate and distinct plenum/reservoir containing a high mass heat exchanger has been eliminated so that the conduit means now serve the function of the plenum, and the heat of thermal energy reservoir within the plenum has been replaced by an electric heating element located within the conduit means for directly heating the air passing thereby "on the fly";
2. The platter having a large central aperture through which air passes out of the cooking chamber has been replaced by a platter having a substantially uniform pattern of smaller apertures which achieve substantially the same "shroud" effect for economical and rapid cooking of the food product; and
3. To enable a better fit of the blower, magnetron and catalytic converter within the available space, the blower motor may be separated form the blower wheel and connected thereto by a flexible drive belt, the magnetron may be rotated and connected to a shorter, vertical circular launcher by a two-part waveguide system, and additional catalytic converter material may be coated on the interior of the conduit walls rather than being present exclusively in a catalytic converter.

To summarize, the present invention provides an oven for quick cooking of a food product, wherein the oven is sufficiently compact for residential use and includes user-operable custom cooking means and/or user-operable custom finishing means. The oven is easy and inexpensive to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. In a compact quick-cooking conventional oven for cooking a food product at least partially by hot gas flow, comprising:

(A) a compact housing defining a quick-cooking cooking chamber having a top, a bottom and means therebetween for receiving a food product for cooking, and conduit means for providing gaseous communication outside of said cooking chamber, between said chamber bottom and said chamber top, said conduit means also serving as a hot gas plenum;

(B) associated with said cooking chamber, directing means for directing gas from said conduit means onto the food product in said cooking chamber, and return means for causing return of at least a portion of the gas from said cooking chamber into said conduit means;

(C) associated with said conduit means, a thermal energy source for heating gas disposed in said conduit means;

(D) flow means for causing a flow of gas from said return means to said directing means via said conduit means;

(E) control means for independently varying at least one of the effective volumetric flow rate of said gas flow into said cooking chamber and the temperature of said gas flow into said chamber;

(F) microwave means for at least partially cooking the food product in said cooking chamber by microwave energy;

(G) user-operable means for generically identifying to said control means the food product placed in said cooking chamber to be cooked; and (H) means for translating the user-operable means of identification into a generic cooking formula specifying cook parameters for all events in the cooking cycle, including the cook time for each event, the percentage of the cook time hot gas energy is used, and the percentage of the cook time microwave energy is used;

the improvement wherein said oven further comprises:

user-operable custom finishing means connected to said control means for causing custom finishing of an already cooked food product after completion of the cooking cycle according to said generic cooking formula-specified cook parameters to further heat the food product, to further brown the food product, or a combination thereof.

2. The oven of claim 1 additionally including a first temperature sensor disposed in or adjacent said cooking chamber, said control means being responsive to said first temperature sensor.

3. The oven of claim 2 additionally including a second temperature sensor disposed in or adjacent said thermal energy source, said control means being responsive to said second temperature sensor.

4. The oven of claim 1 further including user-operable custom cooking means for causing custom cooking of any only partially cooked food product by reducing further heating of the food product, reducing further browning of the food product, or a combination thereof.

5. The oven of claim 1 wherein said conduit means has a free volume of space less than the free volume of space of said cooking chamber.

6. In a compact quick-cooking conventional oven for cooking a food product at least partially by hot gas flow, comprising:

(A) a compact housing defining a quick-cooking cooking chamber having a top, a bottom and a support therebetween for receiving a food product for cooking, and a conduit for providing gaseous communication outside of said cooking chamber, between said chamber bottom and said chamber top, said conduit also serving as a hot gas plenum;

(B) associated with said cooking chamber, a director for directing gas from said conduit onto the food product in said cooking chamber, and a return for causing return of at least a portion of the gas from said cooking chamber into said conduit;

(C) associated with said conduit, a thermal energy source for heating gas disposed in said conduit;

(D) a blower for causing a flow of gas from said return to said director via said conduit;

(E) a control unit for independently varying at least one of the effective volumetric flow rate of said gas flow into said cooking chamber and the temperature of said gas flow into said chamber;

(F) microwave means for at least partially cooking the food product in said cooking chamber by microwave energy;

(G) user-operable means for generically identifying to said control unit the food product placed in said cooking chamber to be cooked; and (H) means for translating the user-operable means of identification into a generic cooking formula specifying cook parameters for all events in the cooking cycle, including the cook time for each event, the percentage of the cook time hot gas energy is used, and the percentage of the cook time microwave energy is used;

the improvement wherein said oven further comprises:

a user-operable custom finishing means connected to said control means for causing custom finishing of an already cooked food product after completion of the cooking cycle according to said generic cooking formula-specified cook parameters to further heat the food product, to further brown the food product, or a combination thereof.

* * * * *